US005676792A

United States Patent [19]

Cairns

[11] Patent Number: 5,676,792

[45] Date of Patent: Oct. 14, 1997

[54] TAPE SPLICING DEVICE

[75] Inventor: John Cairns, Ile-Bizard, Canada

[73] Assignee: Intertape Polymer Group, Interpack Machinery Division, Lachine, Canada

[21] Appl. No.: 554,721

[22] Filed: Nov. 7, 1995

[30] Foreign Application Priority Data

Nov. 10, 1994 [CA] Canada ..... 2135534

[51] Int. Cl.[6] ..... B65H 21/00

[52] U.S. Cl. ..... 156/502; 156/157; 156/504; 242/555.1; 242/555.5

[58] Field of Search ..... 156/157, 159, 156/502, 504; 242/551, 555.1, 555.3, 555.5, 556.1

[56] References Cited

U.S. PATENT DOCUMENTS

| | | | |
|---|---|---|---|
| 2,940,507 | 6/1960 | Butler, Jr. | 242/555.1 X |
| 3,035,787 | 5/1962 | Ota et al. | 242/555.1 |
| 3,381,912 | 5/1968 | Huck | 242/554.3 |
| 3,825,201 | 7/1974 | Osta | 242/554.3 |
| 4,010,061 | 3/1977 | Tokuno | 242/556.1 X |
| 4,108,391 | 8/1978 | Martinez | 242/556.1 X |
| 4,655,865 | 4/1987 | Nozaka | 156/502 X |

*Primary Examiner*—Mark A. Osele
*Attorney, Agent, or Firm*—George A. Seaby

[57] ABSTRACT

A splicing device includes a bracket for mounting on a sealing machine frame, a shaft rotatably mounted on the bracket, the bracket carrying a spindle on each end thereof for a roll of tape, a first handle and brake on one end of the shaft for releasably locking the arm in one position, and a second handle on the other end of the shaft for rotating the shaft and arm, a wiper roller and a separation roller mounted on the frame. A first roll of tape is dispensed from one spindle to a taping head, and a second, fresh roll of tape is on the other spindle. When the first roll of tape is almost completely dispensed, the brake is released and the arm rotated to contact the second roll of tape with the adhesive surface of the first roll. Continued rotation of the arm causes the first roll to wrap partially around the second roll, whereby a paper tab on the leading end of the second roll attaches to the first roll of tape to start dispensing the second roll of tape in overlapping relationship with the trailing end of the first roll. The arm rotates until the used roll passes between the wiper and separation rollers, whereby the trailing end of the used roll engages the separation roll and the new roll engages the wiper roll. The arm is again locked and the trailing end of the old roll is cut.

7 Claims, 9 Drawing Sheets

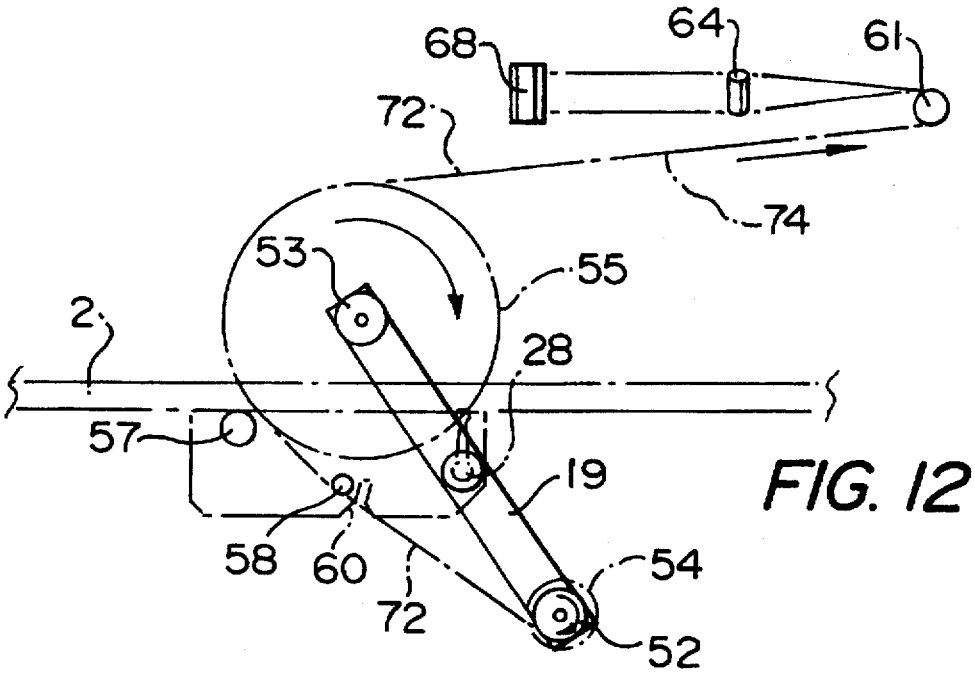
FIG. 12
FIG. 13
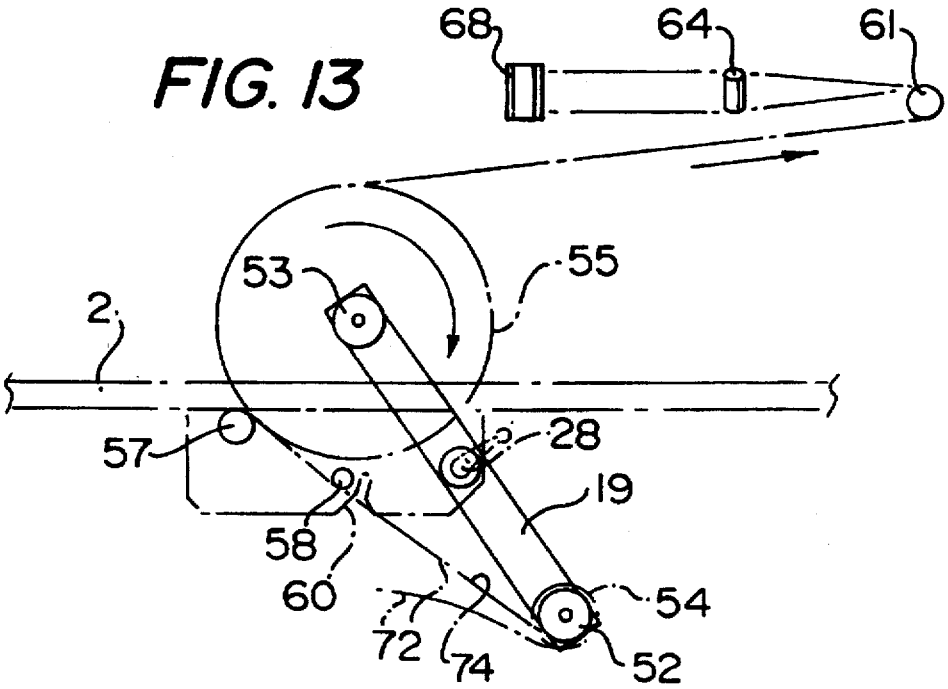

TAPE SPLICING DEVICE

BACKGROUND OF THE INVENTION

1. Field of the Invention

This invention relates to a tape splicing device, and in particular to a device for splicing adhesive tape used in a corrugated carton sealing machine.

2. Discussions of the Prior Art

The machines currently used to seal corrugated cartons include a work table or frame, the top of which is defined by rollers for slidably receiving cartons. The cartons are fed between upper and/or lower tape dispensing heads, which apply tape to the top and/or bottom and ends of the cartons. The tape is dispensed from rolls mounted on arms extending upwardly or downwardly from the dispensing heads. When the tape in a roll runs out, it is necessary to stop the machine and replace the used roll with a new roll of tape. Obviously, it is preferable to avoid stopping the machine. A proposed solution to the problem is the use of a stack of interconnected rolls of tape. However, this solution necessitates a complicated structure for interconnecting the rolls and merely reduces the frequency of machine stoppage.

The present inventor has adopted some of the teachings of patents relating to web splicing in providing a device for splicing adhesive tape. Typical of patents having some features in common with the present invention are U.S. Pat. Nos. 2,172,776, which issued to W. C. Scott on Sep. 12, 1939; 2,320,656, which issued to O. C. Roesen on Jun. 1, 1943; 2,629,562, which issued to P. L. Tollison on Feb. 24, 1953; 3,001,735, which issued to C. J. Francik on Sep. 26, 1961; 3,172,613, which issued to J. M. Simons et al on Mar. 9, 1965; 3,298,890, which issued to A. J. Hellemans on Jan. 17, 1967; 3,381,912, which issued to W. F. Huck on May 7, 1968; 3,547,739, which issued to H. N. Beute on Dec. 15, 1970; 3,622,097, which issued to R. A. Maas on Nov. 23, 1971; 3,647,600, which issued to G. Vischulis et al on Mar. 7, 1972; 3,679,524, which issued to K. W. Bassett et al on Jul. 25, 1972; 3,775,223, which issued to A. J. Moseley et al on Nov. 27, 1973; 3,825,201, which issued to F. Osta on Jul. 23, 1974 and 4,543,152, which issued to Y. Nozaka on Sep. 24, 1985. While the above listed patents provide worthwhile information, they do not provide a simple solution to the problem of interconnecting rolls of adhesive tape so that a taping or sealing machine can be operated on a continuous basis.

The object of the present invention is to provide a solution to the problem in question in the form of a relatively simple tape splicing device.

GENERAL DESCRIPTION OF THE INVENTION

Accordingly, the present invention relates to a device for splicing rolls of adhesive tape comprising frame means; shaft means rotatable on said frame means; arm means centered on said shaft means for rotation relative to said frame means; first spindle means on one end of said arm means for carrying a first roll of tape; second spindle means on the other end of said arm means for carrying a second roll of tape; wiper roller means on said frame means outside of a circular path of travel of said spindle means during rotation of said arm means, said wiper roller means being spaced from said shaft means a distance such that the wiper roller means is outside the path of travel of a nearly used, reduced diameter first roll of tape on one said spindle means and inside the path of travel of a second, larger diameter, fresh roll of tape on the other said spindle means; and separation roller means on said frame means between said shaft means and said wiper roller means inside the path of travel of said spindle means, whereby, with the first roll of tape on the first spindle means being continuously unrolled and fed tangentially around a fixed point to a taping head, when the arm means is rotated in a direction to move the second roll of tape into contact with a adhesive side of the first roll of tape, the first roll of tape causes rotation of said second roll of tape to attach a leading end of the second roll of tape to the trailing end of the first roll of tape while the first roll of tape continues to be fed to the taping head; continued rotation of said arm means causing the second roll of tape to contact the wiper roller means for pressing overlapping lengths of said first and second rolls of tape together; and the first spindle means and the first roll of tape passing between the wiper roller means and the separation roller means, whereby the trailing end of the first roll of tape passed over the separation roller means to the first spindle means, so that said trailing end of the first roll of tape can be severed between said first spindle means and said separation roller means for feeding to the second roll of tape to complete the splice.

BRIEF DESCRIPTION OF THE DRAWINGS

The invention is described in greater detail hereinafter with reference to the accompanying drawings, which illustrate a preferred embodiment of the invention, and wherein:

FIGS. 8 to 13 are schematic top views of the tape splicing device illustrating the operation thereof.

DESCRIPTION OF THE PREFERRED EMBODIMENT

Figure 1:
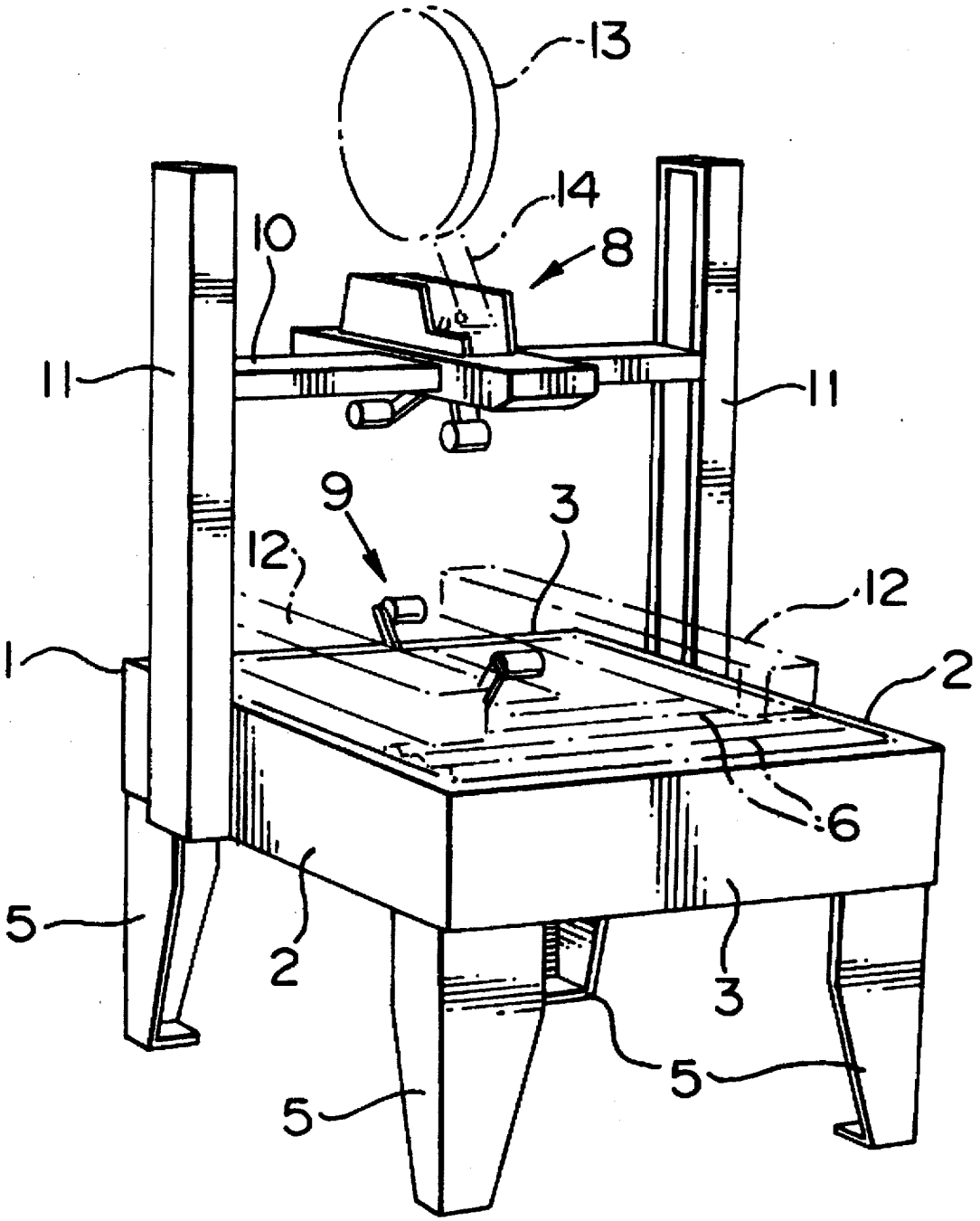
FIG. 1 is a schematic, isometric view of a carton sealing machine of the type on which the device of the present invention is to be used.
Figure 2:
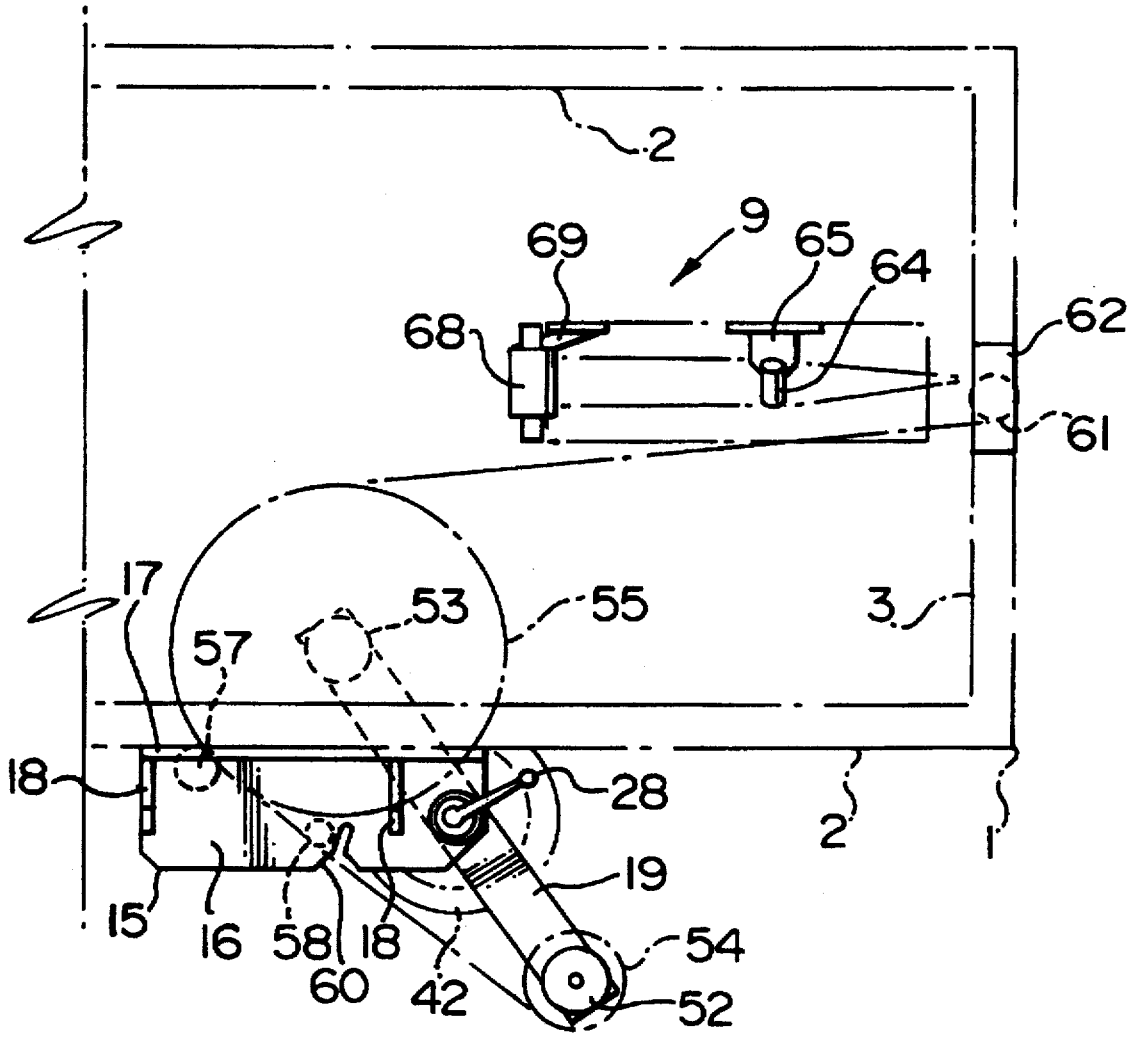
FIG. 2 is a top view of one end of the frame of the machine of FIG. 1 with a device in accordance with the present invention mounted thereon.
Figure 3:
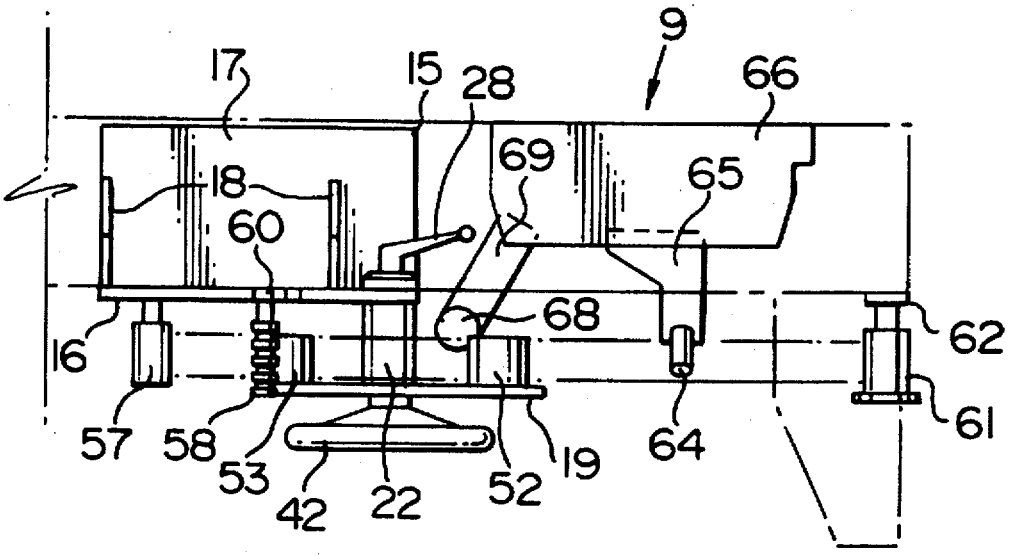
FIG. 3 is a side view of the frame end and the device of FIG. 2.
Figure 4:
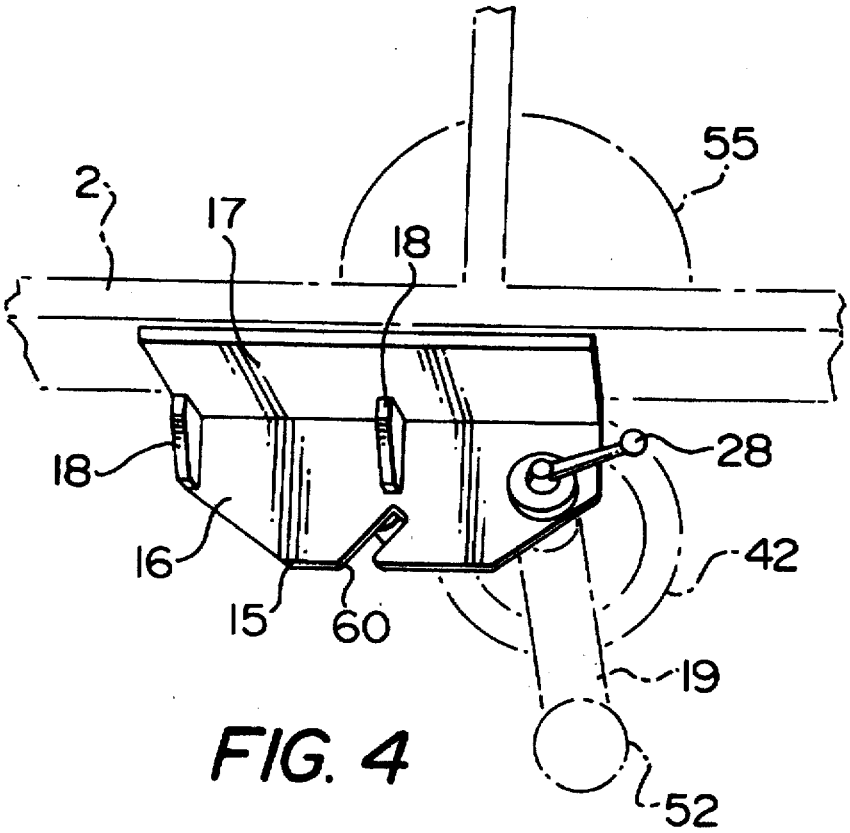
FIG. 4 is an isometric view of a bracket used in the device of FIGS. 2 and 3.
Figure 5:
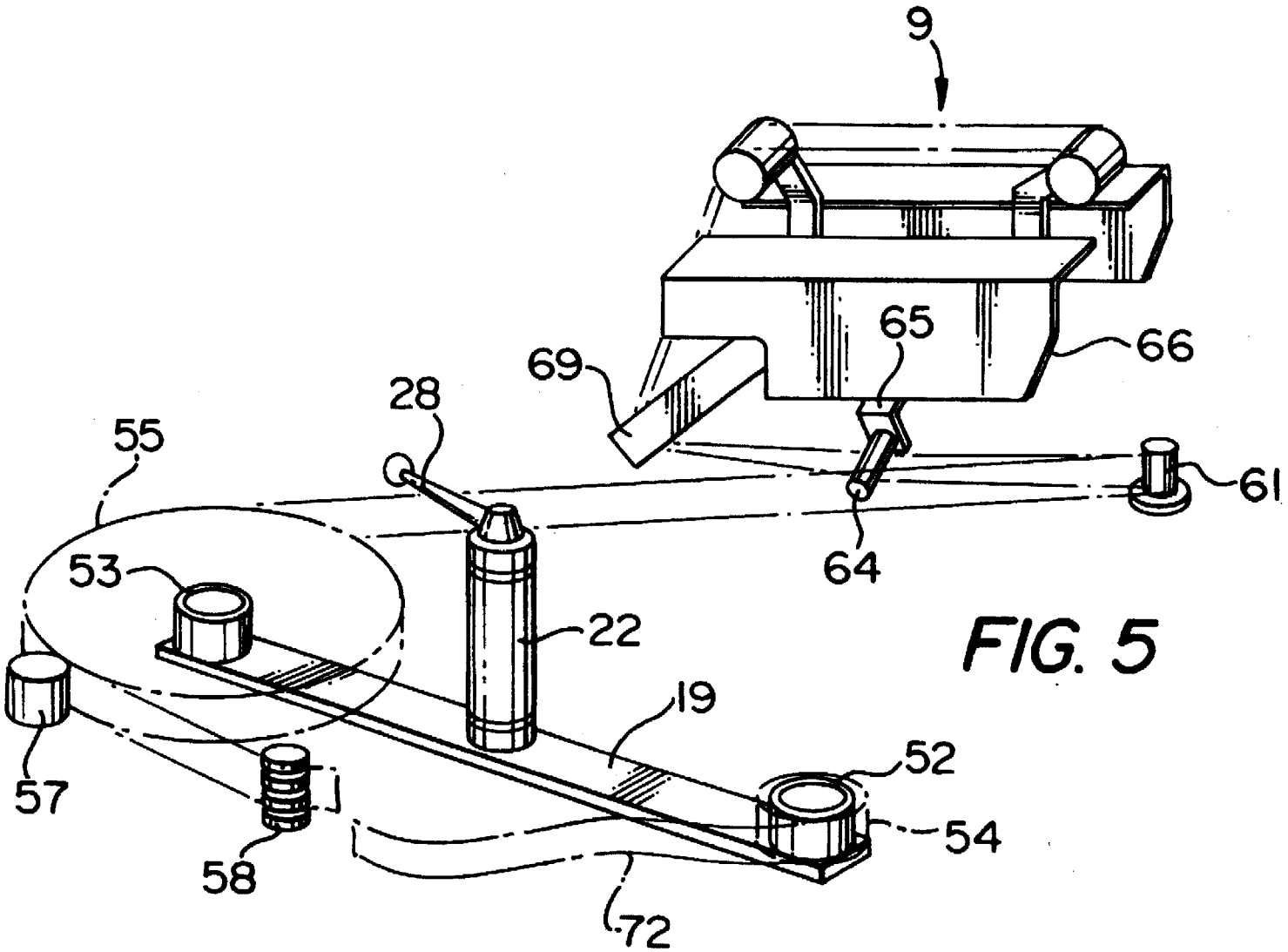
FIG. 5 is a schematic, isometric view of the tape splicing device of FIGS. 2 and 3.

With reference to FIGS. 1 to 3, the tape splicing device of the present invention is intended for use on a machine designed to seal corrugated cartons (not shown). The machine includes a main frame 1 defined by sides 2 and ends 3 supported at the corners by legs 5. The frame 1 carries horizontal rollers 6 for slidably supporting cartons during taping thereof by identical upper and lower tape heads generally indicated at 8 and 9, respectively. The upper tape head 8 is mounted on a crossbar 10 extending between posts 11. The posts 11 are connected to and supported by the sides of the sides 2 of the frame 1. The lower tape head 9 is mounted in an opening in the surface defined by the rollers 6. Endless, motor driven belt assemblies 12 or similar systems are disposed on the sides of the path of travel of the cartons for driving the latter between the tape heads 8 and 9.

Normally, each of the tape heads 8 and 9 carries a roll 13 of tape (one shown). When a roll 13 is empty or nearly empty, the machine must be stopped while the roll is replaced. When a splicing device in accordance with the present invention is used, the arm 14 carrying the roll of tape is omitted from each tape head. While separate tape splicing devices can be provided for each head 8 and 9, the following description relates to a single tape splicing device for use with the lower tape head 9.

Figure 6:
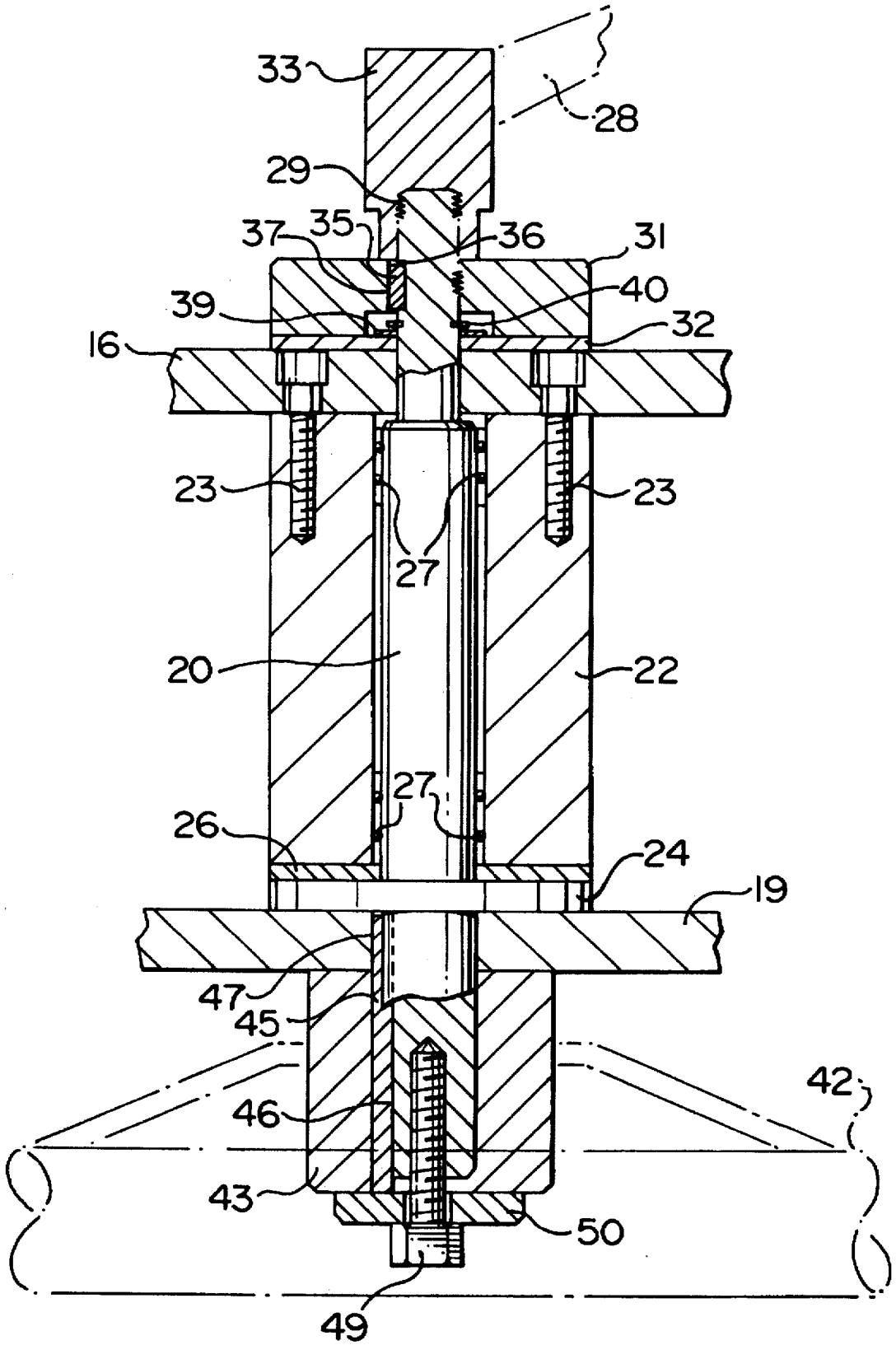
FIG. 6 is a longitudinal, sectional view of a handle assembly used in the device of FIGS. 2 to 5.

Referring to FIGS. 2 and 3, the tape splicing device includes a frame or bracket 15, which is mounted on one side 2 of the machine frame 1. The bracket 15 is defined by a baseplate 16 integral with a back plate 17, and truncated triangular gussets 18 extending between the plates 16 and 17. An elongated arm 19 is suspended connected to one end of the baseplate 16 for rotation around the vertical axis of a shaft 20 (FIG. 6). The shaft 20 is mounted in a cylindrical housing 22 extending between the bottom of the baseplate 16 and the arm 19. The housing 22 is connected to the baseplate 16 by screws 23. An annular flange 24 near the bottom end of the shaft 20 abuts the top surface of the arm 19. A friction washer 26 is provided between the bottom end of the housing 22 and the flange 24, to control the rotation of the arm 19 and the shaft 20 relative to the baseplate 16 and the housing 22. Bearings 27 are provided between the shaft 20 and the housing 22.

Figure 7:
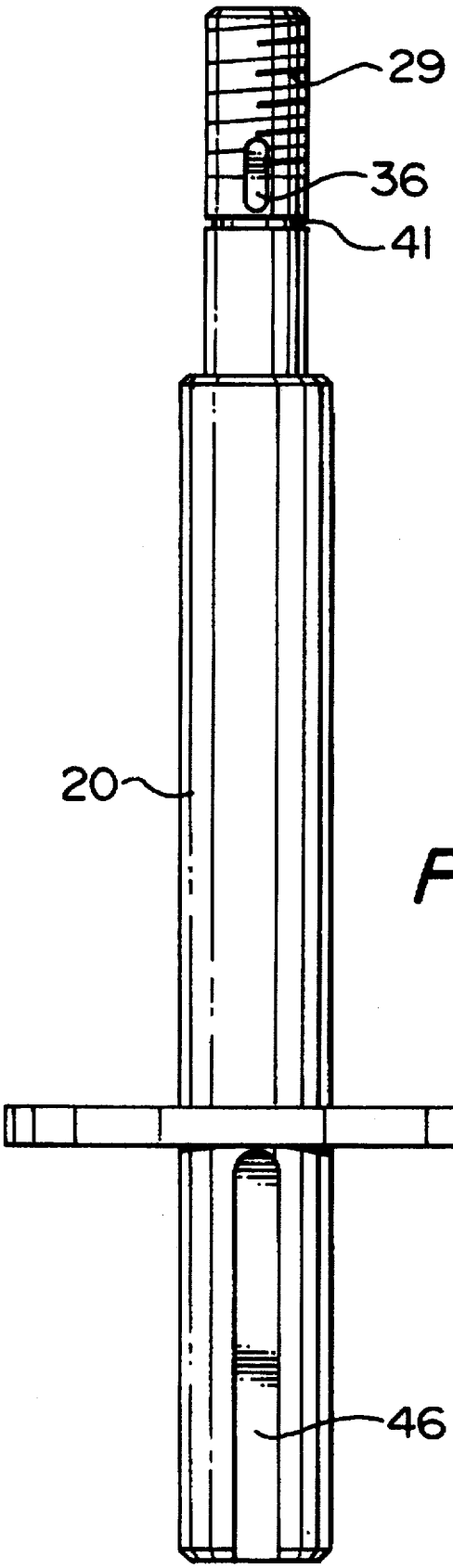
FIG. 7 is a side view of a shaft used in the assembly of FIG. 6.
Figure 8:
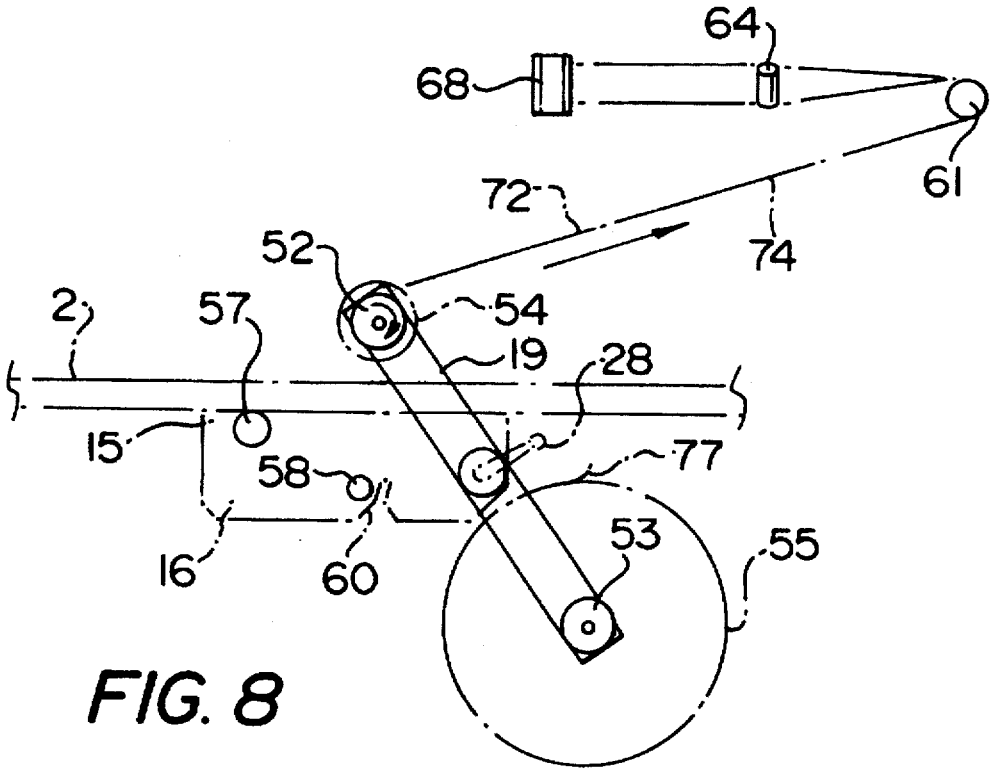
Figure 9:
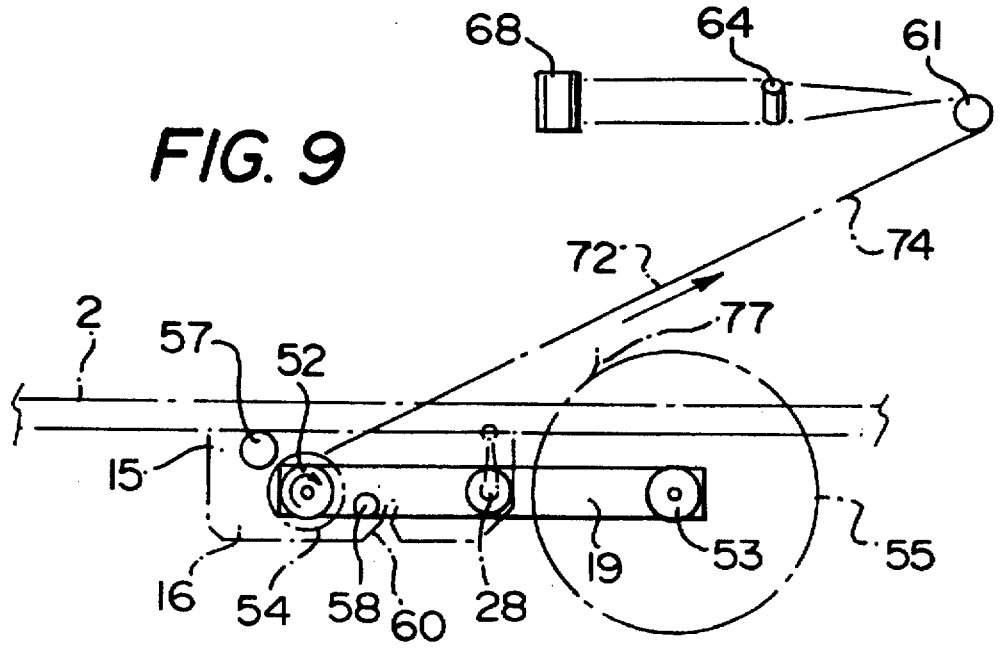

The shaft 20 is releasably locked in one position by a handle 28 mounted on the threaded top end 29 of the shaft 20. A cap 31 and a friction washer 32 are disposed between the cylindrical hub 33 of the handle 28 and the baseplate 16. Rotation of the cap 31 relative to the shaft 20 is prevented by a rectangular key 35 which is inserted into aligned, longitudinally extending grooves 36 and 37 in the shaft 20 and the cap 31, respectively. The friction washer 32 is held on the plate 16 by a washer 39 and a C-clip 40 in an annular groove 41 (FIG. 7) in the shaft 20.

The shaft 20 extends through the arm 19 to a handle 42 defined by a spoked wheel. The cylindrical hub 43 of the wheel 42 is retained on the shaft 20 by a second rectangular key 45 which is inserted into opposed grooves 46 and 47 in the shaft 20 and the hub 43, respectively, and by a bolt 49. A washer 50 is sandwiched between the hub 43 and the head of the bolt 49 for retaining the spline 45 in position. Spindles 52 and 53 are rotatably mounted on the ends of the arm 19 for carrying rolls 54 and 55 of adhesive tape. The tape has an inner adhesive surface and an outer surface treated with a release agent to facilitate unrolling of the tape.

The baseplate 16 also carries a pair of rollers, namely a so-called wipe down or wiper roller 57 proximate the end of the baseplate opposite the shaft 20, and a separation roller 58 at the center of the outer edge of the plate 16 between the shaft 20 and the roller 57. The separation roller 58 has a corrugated or crenellated surface for releasably retaining tape when the adhesive surface of the tape comes into intimate contact with the roller. A slot 60 for receiving a knife blade (not shown) is provided in the outer edge of the plate 16 between the roller 58 and the shaft 20.

A vertical roller 61 for receiving tape from the splicing device and directing the tape towards the bottom tape head 9 is mounted on a T-shaped bracket 62 on the bottom center of one end 3 of the machine frame 1. Another roller 64 inclined at an angle of 45° is rotatably mounted on the bottom end of an arm 65 extending downwardly from the center of the casing 66 of the tape head 9. A third, horizontal roller 68 is rotatably mounted on an arm 69 at the inner end of the taping head casing 66. The rollers 64 and 68 redirect the tape from the vertical to the horizontal for application to a carton.

The operation of the splicing device is described below with reference to FIGS. 8 to 13. During normal operation, a roll 54 of tape 72 is dispensed from the spindle 52 on the inner end of the arm 19. The roll 54 rotates in a clockwise direction, with the adhesive or adhesive surface 74 of the tape facing outwardly toward the side of the machine frame 1 carrying the splicing device. A new roll 55 of tape is placed on the spindle 53 located outside the frame 1 in preparation for splicing operation. When the old roll 54 is almost completely used, i.e. unwound from the spindle 52, the handle 28 is turned to release the pressure of the cap 31 on the friction washer 32. Thus, the shaft 20 and the elements attached thereto, including the handle 42 and the arm 19 are free to rotate. The lower friction washer 26 prevents free wheeling rotation of the shaft 20 and the arm 19.

Figure 10:
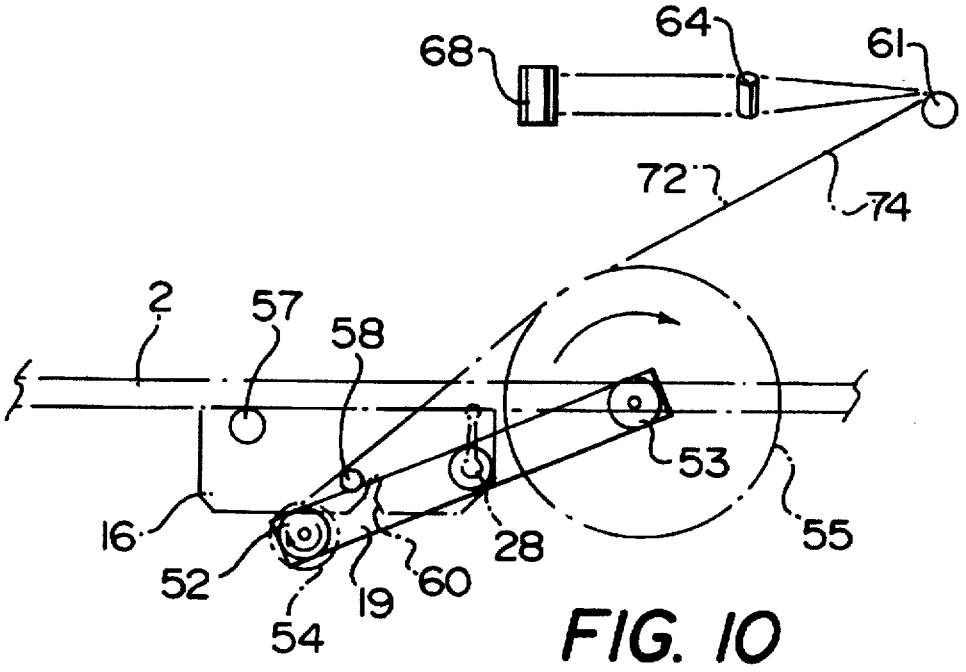
Figure 11:
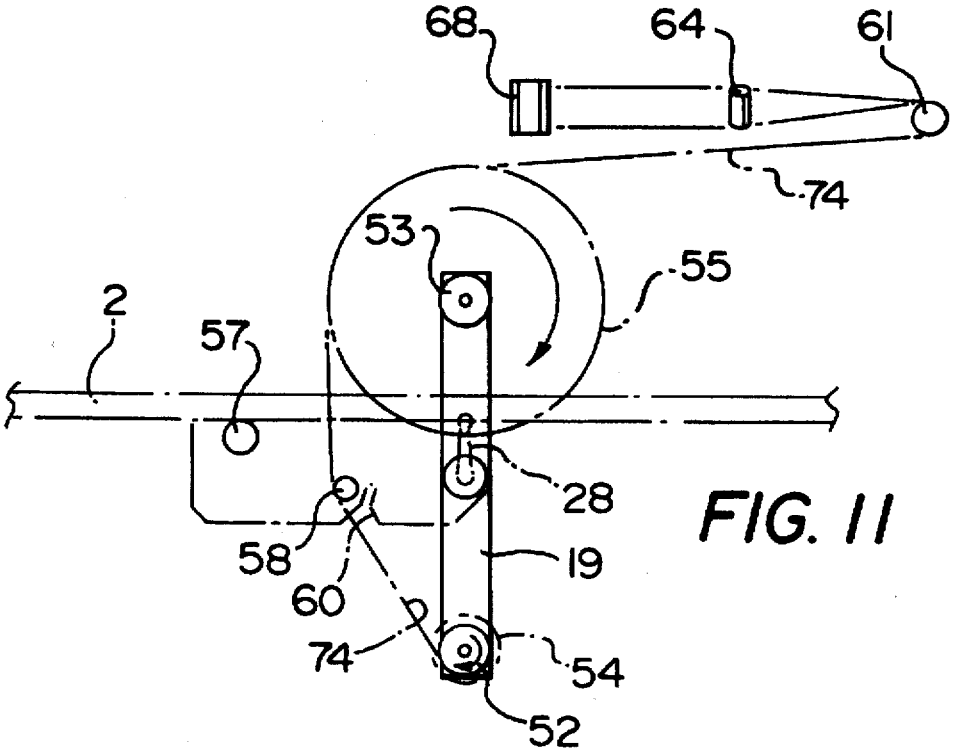

With the release handle 28 loosened, the lower handle 42 is manually rotated to turn the shaft 20 and consequently the arm 19. The arm 19 rotates around the longitudinal axis of the shaft 20 beneath one side 2 of the machine frame 1 (FIG. 9) to move the fresh roll 55 of tape into contact with the adhesive surface 74 of the tape being dispensed from the inner spindle 52 (FIG. 10). When the fresh roll 55 contacts the adhesive surface 74 of the roll 54, the roll 55 is caused to rotate in a clockwise direction, i.e. in the same direction as the roll 54. At the same time, the spindle 52 moves between the wiper and separation rollers 57 and 58, respectively. Thus the spindle 52 moves outside of the side 2 of the machine frame beyond the separation roller 58 and the adhesive surface 74 of the tape 72 on the spindle 52 engages the roller 58 (FIG. 11). The corrugated surface of the roller 58 releasably retains the tape in contact therewith.

Continued rotation of the arm 19 causes the tape from the roll 54 to wrap around the roll 55 (FIGS. 10 and 11). A paper tab 77 (FIGS. 8 and 9) on the leading end of the roll 55 is tightly engaged by the adhesive surface 74 of the roll 54 to cause the tape of the fresh roll 55 to move into overlapping relationship with the tape of the old roll 54 and to start to unroll from the fresh roll 55. The two layers of tape move into the tape head 9.

As illustrated in FIG. 13, when the arm 19 has rotated through 180°, the spindle 52 carrying the old roll 54 of tape has reached the outer position originally occupied by the fresh roll 55. The new roll 55 of tape contacts the wiper roll 57, which acts as a stop. The handle 28 is again turned to tighten the friction washer 32 against the baseplate 16. Thus, the shaft 20 and consequently the arm 19 are locked in the new position. A knife blade (not shown) or another cutting implement is inserted through the slot 60, and the tape of the old roll 54 is cut (FIG. 13). After the tape 72 has been cut, the used roll 54 is removed from the spindle 52. The end of the tape 72 extending between the rollers 57 and 58 is pulled onto the new roll 55 to complete the splice and ultimately applied as part of the double layer area to a carton. The wiper roller 57 presses the layers of tape together to ensure that the trailing end of the splice or overlap area is smooth.

It will be noted that prior to the start of a splicing operation, the angle between the arm 19 and the adhesive surface 74 of the tape 72 being dispensed from the roll 54 is acute. Moreover, the longitudinal axes of the outer spindle 53, the wiper roller 57 and the separation roller 58 lie on a straight line. With this arrangement, the new roll 55 of tape moves a relatively short distance before contacting the adhesive surface of the old roll 54 of tape, and a reasonable length of overlap between the two rolls of tape is assured.

It will be appreciated that the stand or bracket 15 can be replaced by a floor mounted stand (not shown) which is separate form the machine. While the arm 19 rotates around a vertical axis, such arm could be mounted on a bracket or frame to rotate around a horizontal axis, in which case the tape leaving the roll(s) 54 and 55 would already be properly oriented for entry into a taping head 8 or 9. By mounting a sensor (e.g. a light source and a photosensor) proximate the old roll position, a signal could be generated to indicate that a roll splicing operation is required. The signal can be fed to a motor on the platform 15 for rotating the shaft 20 carrying the spindle arm 19. An electrically operated cutter can also be mounted on the bracket 15 for cutting the tape when the old roll reaches the outer, cutting position.

At present, approximately forty percent of cartons are sealed using relatively expensive glue machines. The device of the present invention lends itself to conversion of such glue machines to tape at reduced capital cost, i.e. it is a simple matter to replace glue heads with taping heads and add the splicing device of the present invention to the machine.

I claim:

1. A device for splicing rolls of adhesive tape comprising frame means; shaft means rotatable on said frame means; arm means centered on said shaft means for rotation relative to said frame means; first spindle means on one end of said arm means for carrying a first roll of tape; second spindle means on the other end of said arm means for carrying a second roll of tape; wiper roller means on said frame means outside of a circular path of travel of said spindle means during rotation of said arm means, said wiper roller means being spaced from said shaft means a distance such that the wiper roller means is outside the path of travel of a nearly used, reduced diameter first roll of tape on one said spindle means and inside the path of travel of a second, larger diameter, fresh roll of tape on the other said spindle means; and separation roller means on said frame means between said shaft means and said wiper roller means inside the path of travel of said spindle means, whereby, with the first roll of tape on the first spindle means being continuously unrolled and fed tangentially around a fixed point to a taping head, when the arm means is rotated in a direction to move the second roll of tape into contact with an adhesive side of the first roll of tape, the first roll of tape causes rotation of said second roll of tape to attach a leading end of the second roll of tape to the trailing end of the first roll of tape while the first roll of tape continues to be fed to the taping head; continued rotation of said arm means causing the second roll of tape to contact the wiper roller means for stopping arm rotation and for pressing overlapping lengths of said first and second rolls of tape together; and the first spindle means and the first roll of tape passing between the wiper roller means and the separation roller means, whereby the trailing end of the first roll of tape passed over the separation roller means to the first spindle means, so that said trailing end of the first roll of tape can be severed between said first spindle means and said separation roller means for feeding to the second roll of tape to complete the splice.

2. A device according to claim 1, including first brake means between said shaft means and said frame means for releasably locking said shaft means and said arm means in one position.

3. A device according to claim 2, including second brake means between said frame means and said arm means for resisting rotation of said arm means when said first brake means is released, whereby said arm means is not capable of freewheeling.

4. A device according to claim 3, including first handle means on one end of said shaft means for operating said first brake means, and second handle means on the other end of said shaft means for operating said second brake means.

5. A device according to claim 3, wherein said first brake means include head means on said shaft means; and first friction washer means between said head means and said frame means, and said second brake means includes sleeve means on said frame means rotatably supporting said shaft means between said frame means and said arm means; flange means on said shaft means; and friction washer means between said sleeve means and said flange means.

6. A device according to claim 1, wherein said arm means defines an acute angle with the adhesive side of said first roll of tape prior to a dispensing operation.

7. A device according to claim 6, wherein said frame means includes baseplate means for mounting on one side of a carton taping machine, said shaft means is mounted beneath one end of said baseplate means, said wiper roller means is mounted beneath the other end of said baseplate means opposite the direction of feed of the first roll of tape and said separation roller means is mounted on the center of said baseplate means, whereby a straight line will pass through the longitudinal axes of said second spindle means, said separation roller means and said wiper roller means prior to a dispensing operation.

* * * * *